United States Patent [19]

Brown et al.

[11] 4,016,629

[45] Apr. 12, 1977

[54] FIBER BLENDING MECHANISM

[75] Inventors: Roger S. Brown, New Orleans; Charles L. Shepard, Chalmette; Laurey J. Richard, Metairie, all of La.

[73] Assignee: The United States of America as represented by the Secretary of Agriculture, Washington, D.C.

[22] Filed: May 22, 1975

[21] Appl. No.: 580,093

[52] U.S. Cl. ..... 19/243; 19/288

[51] Int. Cl.[2] ..... D01G 5/00

[58] Field of Search ..... 19/150, 157, 243, 288, 19/291, .23

[56] References Cited

UNITED STATES PATENTS

| | | | |
|---|---|---|---|
| 128,618 | 7/1872 | Harris | 19/243 |
| 545,220 | 8/1895 | Brackett | 19/157 |
| 2,399,148 | 4/1946 | Scott | 19/.25 X |
| 3,216,064 | 11/1965 | Kates, Jr. | 19/243 |
| 3,447,206 | 6/1969 | Klein et al. | 19/243 |

FOREIGN PATENTS OR APPLICATIONS

| | | | |
|---|---|---|---|
| 6,823 | 1910 | United Kingdom | 19/150 |
| 519,200 | 3/1940 | United Kingdom | 19/157 |

*Primary Examiner*—Dorsey Newton
*Attorney, Agent, or Firm*—M. Howard Silverstein; David G. McConnell; Salvador J. Cangemi

[57] ABSTRACT

This invention relates to an apparatus and method for improving the homogeneity of textile fibers which are blended together in a textile drawing machine. Vertical posts are critically aligned with corresponding angled rods which are spaced between a pair of drafting rolls thus substantially forming a guide mechanism which allows for alternating silver of cotton and synthetic fibers to be placed one on the top of the other and drafted together thereby achieving a more uniform and homogeneous blend.

6 Claims, 5 Drawing Figures

FIBER BLENDING MECHANISM

An apparatus and method for improving the homogeneity of textile fibers which are blended together in a textile drawing machine is described. More specifically, a guide mechanism for efficiently and uniformily blending alternating cotton and synthetic fiber slivers by placing one on top the other and drafting them together is achieved. Even more specifically, this is an apparatus and method for efficiently and uniformly blending any alternating fiber slivers by placing one on top the other and drafting them together.

It has been well known in the art that the blending of cotton and synthetic fibers can be initiated in either the opening, the carding, or the drawing operations. Many textile men consider the drawframe the ideal location because the most efficient processing organization for each type fiber can be utilized through carding and the wastes are kept separate. Unfortunately, blending at the drawframe has certain serious drawbacks. The principal problem being the slivers do not blend homogeneously during the drawing process but rather form separate fiber channels within the output sliver. This lack of fiber homogeneity becomes very apparent in the dyed fabric, resulting in reduced quality.

Heretofore, fibers were blended by feeding slivers of different fiber side by side into the drafting rollers and combining the output into a single sliver in an uncontrolled manner. In this side by side arrangement there is no mixing or blending of the fibers in the drafting zone. Furthermore, it has long been known in the art that when you blend two different fibers, a difference in tension will exist between the different fibers causing separation of the drafted slivers while being combined into the single output sliver. This difference in tension is one of the primary causes for the lack of homogeneity in the blended fibers and results in the reduced quality.

Attempts have been made in the past to improve blending at the drawing frame by overlaying the slivers to be blended prior to feeding into the drafting zone. However, this produced too large a bulk of material to be handled by the back roller with the disadvantageous result of an uneven composite sliver produced. Also it is difficult to keep the slivers aligned with each other as they pass through the drafting rollers.

It is the principal object of this invention to provide a means for producing a quality fabric. It is another object of this invention to produce a homogeneously blended yarn. It is yet another object of this invention to obtain a homogeneous blending by improving the drawing process. More specifically, it is the object of this invention to improve the homogeneous blending of different fibers by the use of a guide mechanism to overlay the different slivers in the drafting zone.

Other objects and advantages of this invention will further become apparent hereinafter and in the drawings, in which.

Figure 1:
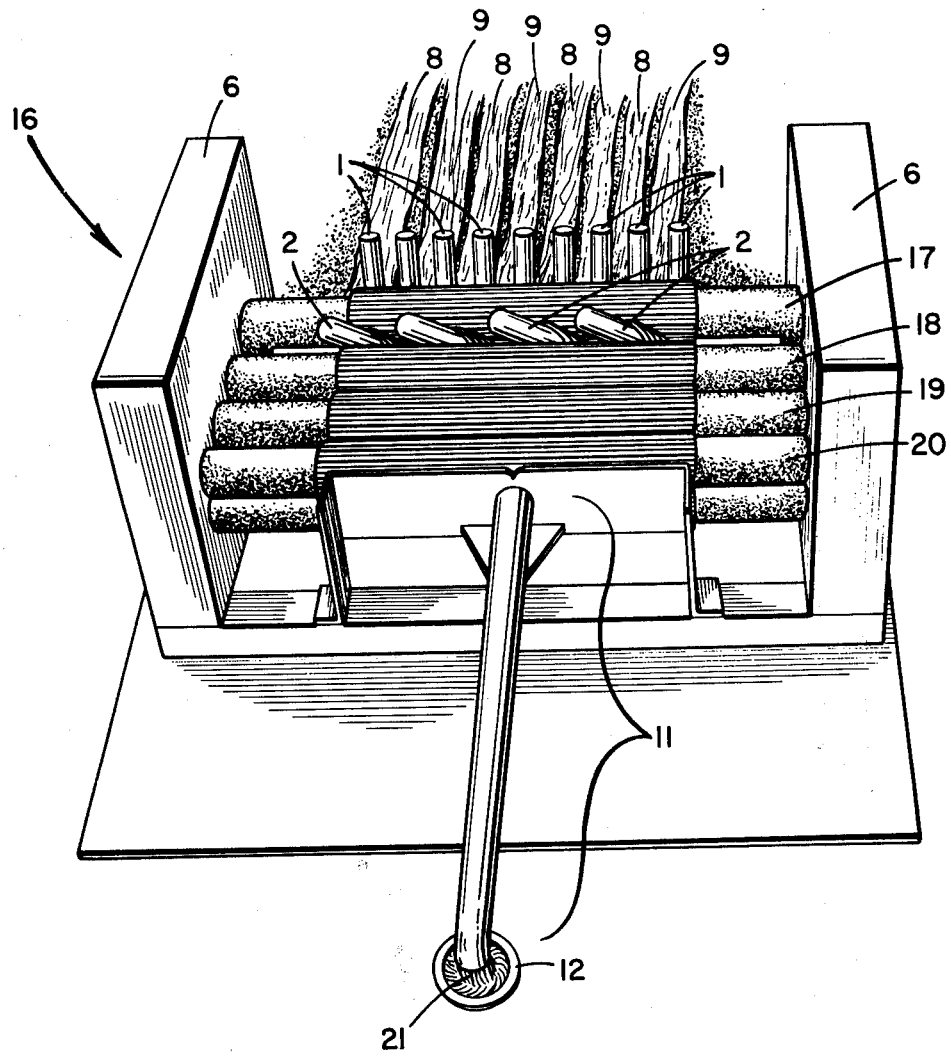
FIG. 1 is isometric view of the guide mechanism as installed in the drafting zone of a conventional drawing frame apparatus.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

Turning now to the specific embodiment of the invention illustrated in the drawings, where the conventional drawing frame drafting zone 16 FIG. 1, contains a conventional four-over-four metallic roll drafting system mounted in a conventional manner between frame sides 6 which is secured to base plate 13. The four-over-four conventional drafting system consists of four top drafting rolls positioned directly over and parallel to four bottom drafting rolls forming top and bottom drafting roll sets 17, 18, 19, and 20. All drafting rollers are driven by any conventional means not shown in the drawings.

Figures 2, 5:
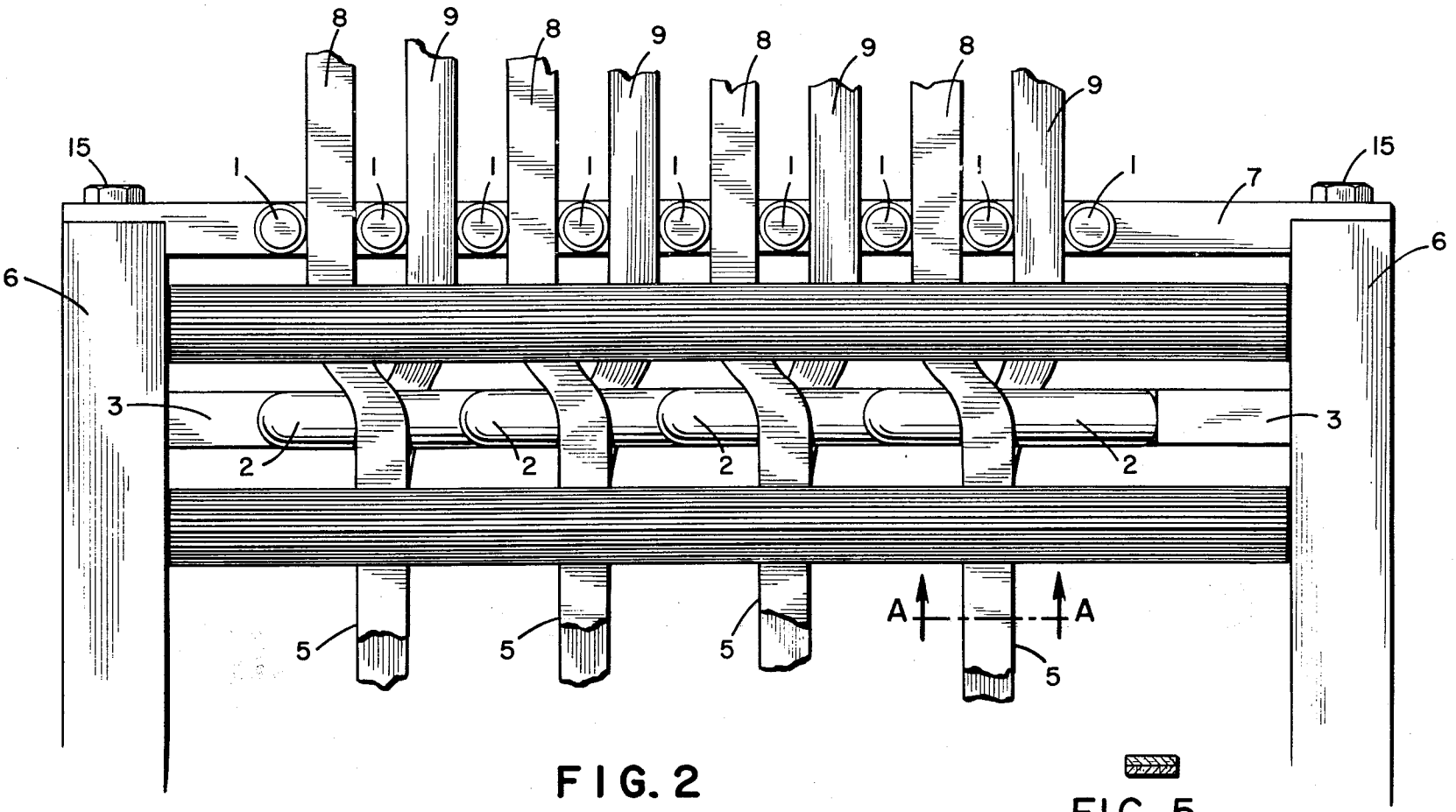
FIG. 2 is a top view showing the position of the vertical guide pins in relation to the angular cross-over pins and the drafting rollers.
FIG. 5 is a cross-sectional view taken along line A—A of FIG. 2 of the sliver after the cotton sliver and synthetic sliver are overlaid.
Figure 3:
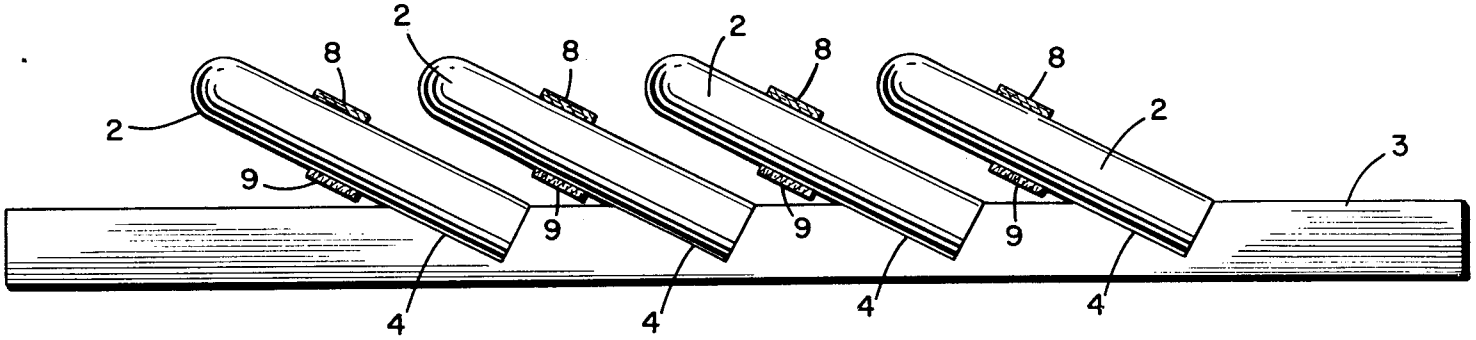
FIG. 3 is a side view of the angular cross-over pins as attached to the mounting bar.
Figure 4:
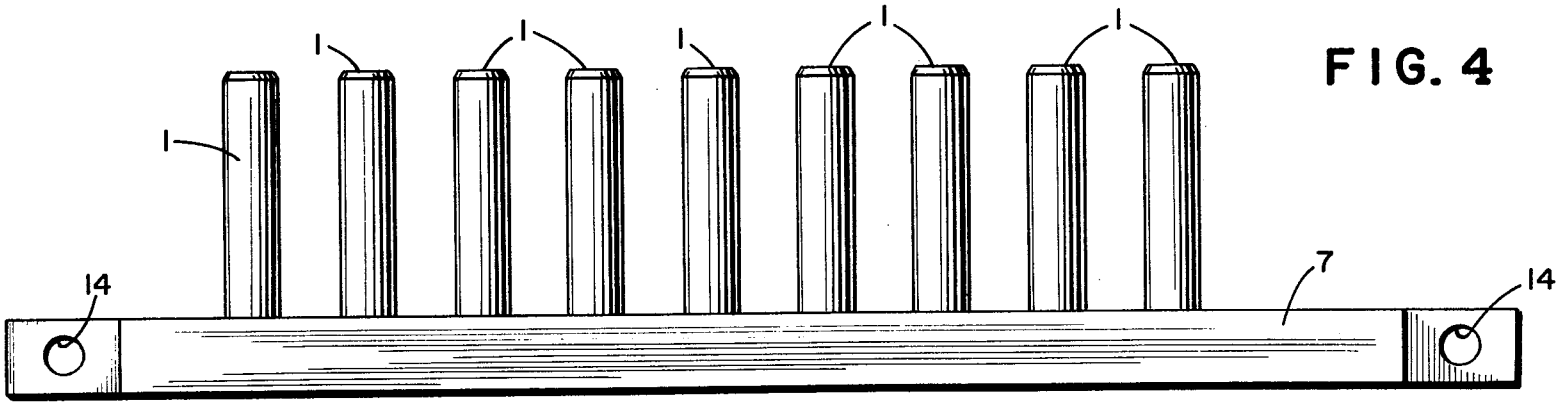
FIG. 4 is a side view of the vertical guide pins as attached to their mounting bar.

The incoming slivers 8 and 9, FIG. 2, which are arranged alternately cotton 8 and synthetic 9 are positioned and guided by vertical guide pins 1, FIGS. 1, 2, 4, which are placed aft and in close proximity to the back drafting rollers 17. Vertical guide pins 1 are attached to vertical guide pin mounting bar 7 by any conventional means. However, in the instant invention, guide pins 1 screw into mounting bar 7. Bar 7 is bolted to side frames 6 parallel to rollers 17 by bolts 15 through holes 14.

Angle cross-over pins 2 are located in the drafting zone positioned between drafting rolls 17, and 18, FIGS. 1 and 2. Angle cross-over pins 2 are attached to angle cross-over pin mounting bar 3 at 27° to the horizontal by screwing into recess 4. Bar 3 is centrally located in the back drafting zone parallel to drafting rollers 17 and 18 and affixed to side frames 6 by any conventional means. Synthetic sliver 9 passes between vertical guide pins 1, between drafting rolls 17, under angle cross-over pin 2, and between drafting rolls 18 exiting into the middle drafting zone between drafting rolls 18 and 19. Simultaneously, cotton sliver 8 passes between vertical guide pins 1, between drafting rolls 17, over angle cross-over pin 2, and between drafting rolls 18 and 19, exactly overlaying sliver 9 and forming a composite blend sliver 5. FIG. 2, Section AA and FIG. 5.

The over-lay composite 5 alignment is accomplished by positioning angle cross-over guide pins 2 so that the pin axial centerline crosses the horizontal plane, defined by the nip of the drafting rolls 17 and 18, at a point in line with the vertical guide pin 1 that is between the slivers 8 and 9 which are to be overlaid with each other.

It was determined emperically during development of the instant invention that a ¾ inch diameter angle cross-over guide pin 2 required installation at 27° to the horizontal plane to result in a perfect composite overlay 5 of sliver 8 and 9. Therefore, any change in the diameter of pin 2 will necessitate a change in the angle of installation of pin 2.

An additional problem encountered in the development of the instant invention occurred when slivers 8 and 9 became entangled as they passed between drafting rollers 17, thus interfering with proper passage around angle cross-over pin 2. Therefore, vertical guide pin 1 was found to be critical in maintaining the proper separation between slivers 8 and 9 as they pass between drafting rollers 17. It was determined that a ½ inch diameter vertical guide pin 1 would result in the proper separation of slivers.

After forming composite sliver 5 they pass through the middle drafting zone between rollers 18 and 19, then through the front drafting zone between drafting rollers 19 and 20 and exit into the conventional fly control pan assembly 11. Here composite slivers 5 are combined forming into the final single sliver 21 as it goes through trumpet 12.

When passing through the middle and front drafting zone additional blending takes place as a result of the mechanical action of the drafting process on the composite slivers 5, resulting in a more homogeneous blend.

Obviously, therefore, it was more advantageous to locate the angle cross-over guide pin in the back drafting zone rather than the middle or front drafting zones.

It is to be understood that the fibers to be blended using this apparatus can be any combination of fibers both natural and synthetic. Furthermore, the instant invention can be incorporated into any conventional drawing frame system.

We claim:

1. An apparatus for the blending of fibers installed in the back drafting zone of a conventional drawing frame and comprising in combination:

a. a means of guiding alternating cotton and synthetic fiber slivers, said means comprising:
   1. a series of vertical cylindrical pins;
   2. a horizontal bar to which said pins are attached;
   3. a vertical frame to which said horizontal bar is affixed at said horizontal bar ends;
   4. a base plate to support said vertical frame;

b. a first set of drafting rolls located parallel to and forward of said guiding means, to receive said synthetic fiber sliver from said guiding means;

c. a frame to which said first set of drafting rolls are mounted;

d. an angular cross-over guiding means, located parallel to and forward of the first set of drafting rolls, said cross-over guiding means angled and positioned to separate, deflect and perfectly overlay the alternating cotton and synthetic slivers into composite slivers;

e. a second set of drafting rolls located parallel to and forward of the cross-over guiding means, said second set of drafting rolls receiving the composite slivers from the angled guiding means and drafting them into a homogeneous blend;

f. the frame of (c) for mounting said second set of drafting rolls.

2. The apparatus of claim 1 wherein the angular cross-over guiding means comprises:

a. a series of angled cylindrical pins;

b. a horizontal mounting bar to which said pins are mounted for stability;

c. the frame of 11 (c) to which said horizontal mounting bar is affixed.

3. The apparatus of claim 2 wherein the horizontal mounting bar is recessed at the points of angled pin attachment, said recess angled complimentary to the angle of the angular guide pins.

4. The apparatus defined in claim 1 wherein the guiding means comprises nine cylindrical vertical pins, ½ inch in diameter, and screwed into the horizontal mounting bar so as to provide a ½ inch space between pins.

5. The apparatus as defined in claim 1 wherein the horizontal bar which supports the vertical pins is affixed at its ends to a vertical frame which is attached by a bolt passing through a hole in the bar and screwed into the frame of 11 (c) at each end.

6. The apparatus as defined in claim 1 wherein the angled guide pins are cylindrical, ¾ inch in diameter and set at a 27° angle to the horizontal, and screwed into a horizontal mounting bar, said mounting bar sufficiently recessed at a complimentary angle to accept the angled pins.

* * * * *